US011161034B1

(12) United States Patent
Putnam

(10) Patent No.: US 11,161,034 B1
(45) Date of Patent: Nov. 2, 2021

(54) CARD GAME

(71) Applicant: Miles Putnam, Ann Arbor, MI (US)

(72) Inventor: Miles Putnam, Ann Arbor, MI (US)

( * ) Notice: Subject to any disclaimer, the term of this patent is extended or adjusted under 35 U.S.C. 154(b) by 0 days.

(21) Appl. No.: 16/990,687

(22) Filed: Aug. 11, 2020

(51) Int. Cl.
*A63F 1/04* (2006.01)
*A63F 9/18* (2006.01)
*A63F 1/02* (2006.01)

(52) U.S. Cl.
CPC ..... *A63F 9/18* (2013.01); *A63F 1/02* (2013.01); *A63F 1/04* (2013.01); *A63F 2001/0408* (2013.01); *A63F 2001/0416* (2013.01); *A63F 2001/0458* (2013.01); *A63F 2001/0466* (2013.01); *A63F 2001/0475* (2013.01); *A63F 2009/188* (2013.01)

(58) Field of Classification Search
CPC ..... A63F 9/18; A63F 2001/0408; A63F 2001/0416; A63F 2001/0458; A63F 2001/0466; A63F 2001/0475; A63F 1/04
USPC ..... 273/302–305, 307, 308, 429–432
See application file for complete search history.

(56) References Cited

U.S. PATENT DOCUMENTS 1,632,941 A * 6/1927 Abell ..... A63F 1/02 273/303
5,887,873 A * 3/1999 Freeman ..... A63F 1/00 273/303
6,948,938 B1 * 9/2005 Tseng ..... G09B 19/06 273/299

* cited by examiner

*Primary Examiner* — Benjamin Layno
(74) *Attorney, Agent, or Firm* — Heed Law Group PLLC; Thomas Heed

(57) ABSTRACT

A new trivia-based card game comprising a deck of cards with a plurality of planar playing cards. Each planar playing card has three orthogonal pieces of information on its playing surface: an index, a card value, and a topic. Each planar playing card also has an answer value list and an answer list on its playing surface. The deck of cards may be sorted into unique sub-sets based off of index, card value, or topic. All of the planar playing cards contained in each sub-set sorted by topic share an answer value list and an answer list. A trivia-based card game can be played with such a deck.

20 Claims, 13 Drawing Sheets

CARD GAME

FIELD OF INVENTION

This invention relates to the classifications for sports; games; amusement, and to one or more sub-classification related to card games. More specifically, the present invention is novel set of playing cards and a method of playing a card game.

BACKGROUND OF INVENTION

Playing cards are ubiquitous because of their versatility, cost, and form factor. Properly understood, playing cards include an index and a value. In a standard set of playing card, the indices are ♣ (clubs), ♦ (diamonds), ♥ (hearts), and ♠ (spades). The indices in a standard set of playing cards is typically called the suit. The indices can be ordered for certain games, typically, as ♣, ♦, ♥, and ♠.

The cards also include a value A (ace), 2, 3, 4, 5, 6, 7, 8, 9, 10, J (jack), Q (queen), and K (king). The value can have an order or ranking, usually either listed as A, 2, 3, 4, 5, 6, 7, 8, 9, 10, J, Q, and K (aces low) or 2, 3, 4, 5, 6, 7, 8, 9, 10, J, Q, K, and A (aces high).

Each playing card has one suit and one card value. In a standard set of playing cards, they are mapped one-to-one. This means there is one, but only one, of each value in each suit. So, there is one A♣, one A♦, one A♥, and one A♠. In total, there are 52 playing cards.

The index and value are orthogonal data, meaning that the index does not influence the value and vice versa. As a result, a wide variety of games can be played using a standard set of playing cards, such as poker, blackjack, go fish, spades, hearts, and I doubt it.

In some specialty decks, such as pinochle, the cards may be mapped differently. For example, in a pinochle deck, each suit has two 9, 10, J, Q, K, and A. So, there are two A♣, two A♦, two A♥, and two A♠. In total, there are 48 playing cards. Additionally, some games, like Euchre, use either half of a pinochle deck or a modified standard deck of playing cards. Playing cards are ubiquitous precisely because they are so flexible, allowing users to play a large number of games.

The concept of playing cards can be extended to other sorts of games, such as trivia games, by using the index and value system to order information.

SUMMARY OF THE INVENTION

This summary is intended to disclose a card game played with a new deck of cards. This summary is not intended to limit the scope of the claimed subject matter. Rather, it is intended to provide one skilled in the art with an overview of the invention by referencing its main embodiments. The invention taught extends beyond the simplified concepts taught in this summary.

The present invention is a plurality of planar playing cards that is used for a trivia game. A plurality of planar playing cards is typically called a "deck." Each of the plurality of planar playing cards has a playing surface and a perimeter. The playing surface contains information. In a standard deck of playing cards, there is the suit ♣, ♦, ♥, and ♠; and the value A, 2, 3, 4, 5, 6, 7, 8, 9, 10, J, Q, and K. The suit and value in a standard deck of playing cards are orthogonal, meaning that you do not know the card value by knowing the suit, and you do not know the suit by knowing the card value.

In the present invention, there are three pieces of orthogonal information residing on the playing surface of each of the plurality of planar playing cards, an index chosen from a set of index values, a card value chosen from a set of card values, and a topic chosen from a set of topic values. A suit would be an example of an index value. An index could also be other sets of symbols, alphanumeric characters, or colors. Each of the orthogonal pieces of information allows the deck of cards to be sorted into specific sub-sets. For example, in a standard set of playing cards, the cards can be sorted into four sub-sets, by suit. The sub-sets created by the index are distinct or unique from those created by the card value and topic. Again, using a standard deck of playing cards for reference, the sub-sets of suits ♣, ♦, ♥, and ♠; is different than the sub-sets of card values A, 2, 3, 4, 5, 6, 7, 8, 9, 10, J, Q, and K.

The playing surface of the playing cards for the present invention also includes a list of answer values selected from a set of answer values; and a list of answers selected from a set of answers. Each answer value list contains a plurality of unique answer values and each answer list contains a plurality of unique answers. Each answer in the list of answers relates to the topic on the card. Each answer in the list of answers maps, one-to-one with an answer value in the list of answer values. The set of card values has to include the set of answer values. Each card has a unique combination of index, card value, and topic. The plurality of planar playing cards can be sorted into sub-sets by topic. All planar playing cards in a sub-set sorted by topic will have an identical list of answer values and an identical list of answers. There is no necessity that the sub-sets sorted by topic number more than one. However, if there is more than one card in each sub-set sorted by topic, they must contain identical answer lists.

The new card game can be mapped onto a traditional set of playing cards, making a dual-use deck. In other words, the cards of the present invention could be used for a traditional card game played with a traditional deck of playing cards. The cards of the present invention could also be used for a trivia game. Mapping the present invention onto a deck of standard playing cards, the set of index values is ♣, ♦, ♥, and ♠; and the set of card values is Ace, 2, 3, 4, 5, 6, 7, 8, 9, 10, Jack, Queen, and King. Mapping the present invention onto a standard set of cards means that each of the plurality of cards has a unique combination of index and card value. Topics, lists of answer values, and lists of answers would be mapped onto the standard set of playing cards, also.

In one embodiment, at least two indices, in this case suits, share a common set of topics. For example, ♦ and ♥ can be made identical, with the exception of the index value. This allows the cards to be easily sorted into sub-sets for game play. For ease in printing and reading, when mapping the present invention to a standard deck of cards, the set of answer values is limited to Ace, 2, 3, 4, 5, 6, 7, 8, 9, 10. The answer value list for each of the plurality of planar playing cards contains all the values in the set of answer values. This limitation is strictly for practical purposes of maximizing the question on the playing surface of the card, while still maintaining readability.

The cards would lend themselves to a trivia game. Players would be divided into at least two teams. The game would include selecting a clue-giver from a group of players; having the clue-giver select a first card from the plurality of planar playing cards; communicating the information on the first planar playing card to the players; having the clue-giver select a second card from the plurality of planar playing cards; having the clue-giver keep a piece of specific information on the second planar playing cards secret, which maps to a specific piece of seen but undisclosed information contained on the first card; having the clue-giver provide clues that allow the players to ascertain the seen but undisclosed information contained on the first card; allowing the players to guess the seen but undisclosed information contained on the first card; and scoring the game based on who correctly guessed the seen but undisclosed information contained on the first card. Specifically, when the clue-giver selects the second card, the clue-giver maps the card value from the second card onto the answer value list of the first card in order to ascertain the seen but undisclosed information contained on the first card: the correct answer. This means that the clue-giver wants the players to guess the answer on the first card that corresponds to the answer value on the first card that matches the card value of the second card. The clue-giver does this by giving clues that disclose the correct answer, but without saying the correct answer. Again, the clue-giver knows the specific secret information contained on the second card is the card value, but no one else does. The clue-giver is then able to map the card value of the second card onto the answer values of the first card to determine the correct answer. The clue-giver provides clues about the correct answer on the first card but does not disclose the correct answer.

In one alternative embodiment, at the beginning of the game, the players are divided into two or more teams. In one alternative embodiment, when the cards are sorted into sub-sets according to indices, two or more indices would contain identical topics. At the beginning of the game, the plurality of cards comprising the present invention would be sorted into sub-sets according to indices, allowing each team to receive a sub-set of cards containing identical topics. For example, if the indices ♦ and ♥ had identical cards, the deck of cards could be sorted by suit (index) and each team would receive either ♦ or ♥. In another alternative embodiment, on each of the plurality of planar playing cards, for the answer value matching the card value, the answer would be left blank. This would be done as a reminder of the card value of the individual planar playing card.

This Summary is provided to introduce a selection of concepts in a simplified form that are further described below in the Detailed Description, with reference to the drawings contained in this application.

BRIEF DESCRIPTION OF THE DRAWINGS

The present invention is illustrated with 4 figures on 13 sheets. The accompanying drawings, which are incorporated in and constitute a part of this disclosure, illustrate various example embodiments. In the drawings.

DETAILED DESCRIPTION OF THE DRAWINGS

Figure 1A:
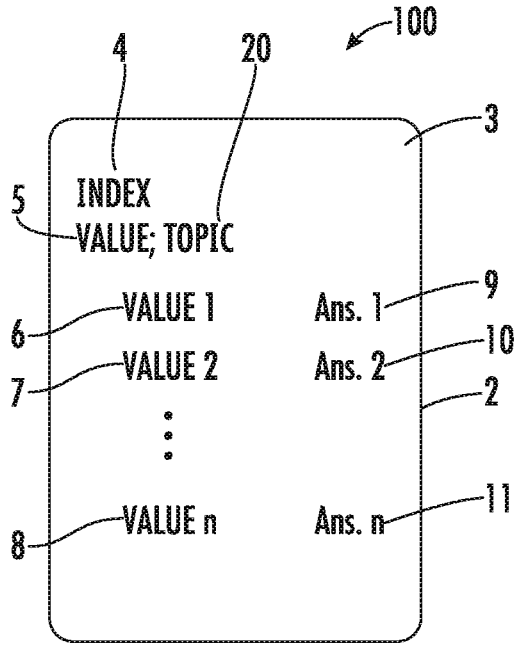
FIG. 1A shows a generic embodiment of a new card for the new deck of cards.

The following descriptions are not meant to limit the invention, but rather to add to the summary of invention, and illustrate the present invention, a new card game. The present invention is illustrated with a variety of drawings showing an abstract version of the new card game as well as an actual version mapped onto a standard set of playing cards.

Certain terminology is used in the following description for convenience only and is not limiting. To assist in the description of the present invention, words such as short, long, top, bottom, side, upper, lower, front, rear, inner, outer, right and left are used to describe the relative size and orientation of the present invention in the accompanying figures. The terminology includes the words above specifically mentioned, derivatives thereof, and words of similar import.

The following detailed description refers to the accompanying drawings. Wherever possible, the same reference numbers are used in the drawings and the following description to refer to the same or similar elements. While embodiments of the claimed subject matter may be described, modifications, adaptations, and other implementations are possible. Substitutions, additions, or modifications, which perform identical functions to the embodiments disclosed, may be made to the elements illustrated in the drawings.

In its simplest embodiment in FIG. 1A, the present invention is a card 100 game comprised of a plurality of planar playing cards 100, typically referred to as a deck. A planar playing card 100 has a playing surface 3 and a perimeter 2. The perimeter 2 is typically rectangular with fillets 2, but the actual shape of the perimeter 2 is not a limitation of this invention 100.

The planar playing card 100 has three orthogonal pieces of data: a card index 4, a card value 5, and a card topic 20. In this context, orthogonal means that the card index 4, the card value 5, and the card topic 20 are uncorrelated with one another. The planar playing card 100 has the card index 4, card value 5, and card topic 20 printed or otherwise represented on the playing surface 3. On its playing surface 3, the planar playing card 100 includes a list of answer values 6, 7, 8. Typically, the list of answer values 6, 7, 8 is ordinal, but this is not a limitation of this invention. Each answer value 6, 7, 8 has a corresponding answer 9, 10, 11. The answer values 6, 7, 8 are mapped, one-to-one, to the answers 9, 10, 11. The answers 9, 10, 11 relate to the topic. Therefore, the answers 9, 10, 11 are not an orthogonal piece of data, but rather are correlated with both the card value 5, and the card topic 20.

Figure 1B:
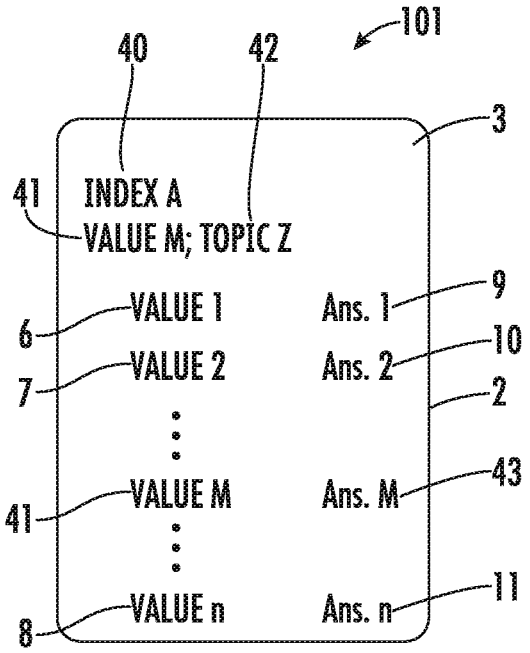
FIG. 1B shows an alternative generic embodiment of a new card for the new deck of cards.
Figure 1C:
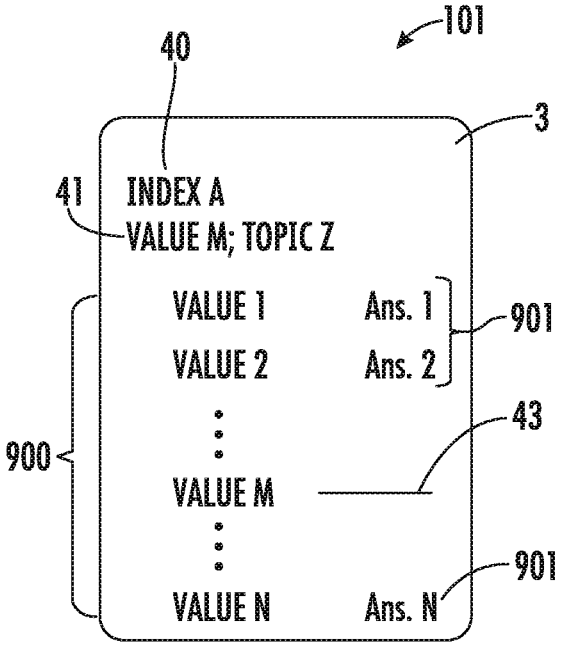
FIG. 1C shows another alternative generic embodiment of a new card for the new deck of cards.

FIGS. 1B and 1C show a planar playing card 101 with a particular index value 40 of "A", a particular card value 41 of "M", and a particular card topic 42 of "Z". The planar playing card 101 includes a list 900 of answer values 6, 7, 8, from 1 to n, where n is an integer value. Each answer value 6, 7, 8 has a corresponding answer 9, 10, 11. The card value 41 of "M" is included somewhere on the list of answer values 6, 7, 8, 41. The list 900 of answer values 6, 7, 8, 41, including the card value 41 are usually presented in an ordinal fashion. The answer values 6, 7, 8, 41 are mapped, one-to-one, to the answers 9, 10, 11, 42. The answers 9, 10, 11 are typically presented as an answer list 901 with the exception of the answer 43 corresponding to the card value 41. In this embodiment, the answer 43 corresponding to the card value 41 is a blank, represented by a line. This is done to provide a visual indication of what the card value is during game play. With the exception of the answer 43 corresponding to the card value 41, the answers 9, 10, 11 relate to the topic 42.

A plurality of planar playing cards 101 so arranged lends itself to a compact and interesting game of trivia. As an example of potential game play, in the preferred embodiment, the players select a clue-giver. The clue-giver selects a planar playing card 101 at random from the plurality of planar playing cards 101 and presents it to all players. This is the topic 42 planar playing card 101. The clue giver selects a second planar playing card 101 from the plurality of planar playing cards 101 and does not reveal it to the other players. The second planar playing card 101 has a card value 41, which is the correct answer (e.g., 6, 7, or 8) for the first planar playing card 101 that was revealed to all players. So the correct answer on the first planar playing card 101 is seen but undisclosed to the players, with the exception of the clue-giver.

The clue-giver communicates the correct answer to the players. The clue-giver gives clues about the correct answer, but does not reveal the correct answer. During game player, the players may either call out the answer when they know it; or alternately, they may all wait until the clue-giver is done giving clues. When the clue-giver is satisfied that they have communicated the correct answer, without providing the correct answer, the players are allowed to guess the correct answer.

In an alternative embodiment, the invention lends itself to team play.

The players are divided into two or more teams. In one embodiment, all teams use the same plurality of planar playing cards. In another alternative embodiment, each team receives a plurality of cards containing plurality of card values 6, 7, 8, 41 arranged in a list 900, with a single index value 40. The index value 40 of each team is typically different, but it need not be. However, the sequence of card values 6, 7, 8, 41 is identical for both teams. A topic 42 is mapped onto a card value 41 in a one-to-one fashion, so that the two teams, although possessing a plurality of cards with a different index value 40 have a plurality of cards containing the same topics 42.

In this embodiment, the opposing team would guess first, but a suitable game can be fashioned with either team guessing first. Each team gives one answer.

In an alternative embodiment, only the opposing team can score. The opposing team would get zero points for an incorrect guess, if the clue-giver's team is correct. The opposing team would get 1 point if they are correct and the clue-giver's team is correct. The opposing team would get 3 points for a correct guess, if the clue-giver's team was incorrect. A game would be played to 3 points. Of course, the order of guessing and actual score keeping can be easily modified to suit the players.

FIGS. 2A-2E, 3A-3E, and 4 show the present invention mapped onto a traditional set of playing cards. FIGS. 2A-2E shows a plurality of planar playing cards 200, 201, 202, 203, 204, 205, 206, 207, 208, 209, 300, 301, 302, 303, 304, 305, 306, 307, 308, 309. The first plurality of planar playing cards 200, 201, 202, 203, 204, 205, 206, 207, 208, 209 are hearts, ♥ 400. This is the sub-set of planar playing cards with hearts 400. The second plurality of cards 300, 301, 302, 303, 304, 305, 306, 307, 308, 309 are diamonds, ♦ 401. This is the sub-set of planar playing cards with diamonds 401. The hearts ♥ 400 and diamonds, ♦ 401 are each an index, as are spades ♠ 402 and clubs, ♣ 403.

Other indexing systems can be used, such as symbols, alphanumeric characters, or colors For example, the symbols, #, @, $, and & can form a set of index values. Greek letters, such as Δ, Σ, Ω, and Φ, can also form a set of index symbols. Likewise, the letters A, B, C, and D can form a set of index values. Even the set of primary colors, red, blue, green, yellow, orange, and purple, can form a set of index values.

The A 500 of ♥ 400 card 200 and the A 500 of ♦ 401 card 300 share a topic 800, "Road Trip." The 2 501 of ♥ 400 card 201 and the 2 500 of ♦ 401 card 301 share a topic 801, "Sense of Touch." The 3 502 of ♥ 400 card 202 and the 3 502 of ♦ 401 card 302 share a topic 802, "Beautiful Music." The 4 503 of ♥ 400 card 203 and the 4 503 of ♦ 401 card 303 share a topic 803, "Feelings." The 5 504 of ♥ 400 card 204 and the 5 504 of ♦ 401 card 304 share a topic 804, "Fantasy Creatures." The 6 505 of ♥ 400 card 205 and the 6 505 of ♦ 401 card 305 share a topic 805, "Ball Games." The 7 506 of ♥ 400 card 206 and the 7 506 of ♦ 401 card 306 share a topic 806, "Vegetation." The 8 507 of ♥ 400 card 207 and the 8 507 of ♦ 401 card 307 share a topic 807, "Let's Eat." The 9 508 of ♥ 400 card 208 and the 9 508 of ♦ 401 card 308 share a topic 808, "Rest Easy." The 10 509 of ♥ 400 card 209 and the 10 509 of ♦ 401 card 309 share a topic 809, "Hobby Shop."

Figure 2A:
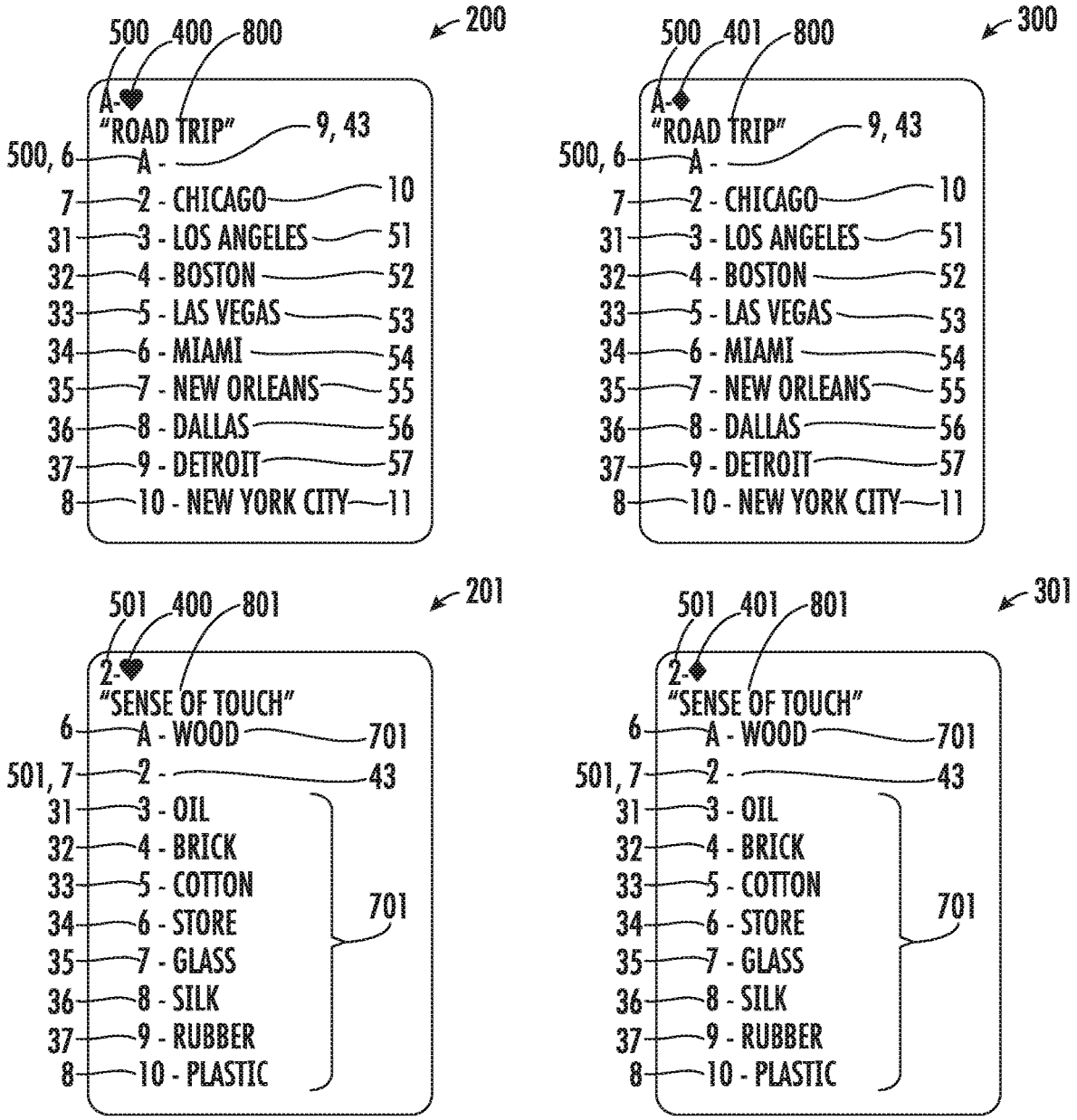
FIG. 2A shows four cards of the primary embodiment of the present invention, a trivia game mapped onto a standard set of playing cards: A♥, A♦, 2♥, and 2♦.

FIG. 2A shows four cards 200, 201, 300, 301, the A♥, A♦, 2♥, 2♦ 200, 300, 201, 301, respectively. The cards 200, 300 bearing the A 500 of ♥ 400 and A 500 of ♦ 401 share a topic 800, answer values 6, 7, 31, 32, 33, 34, 35, 36, 37, 8, and answers 10, 51, 52, 53, 54, 55, 56, 57, 11. The card value 500 for A 500 is shown at the top of the card as a card value 500 and as an answer value 500, 6. Likewise, the cards 201, 301 bearing the 2 501 of ♥ 400 and 2 500 of ♦ 401 share a topic 801, answer values 6, 7, 31, 32, 33, 34, 35, 36, 37, 8, and list 701. The card value 501 for 2 501 is shown at the top of the card as a card value 501 and as an answer value 501, 7.

Figure 2B:
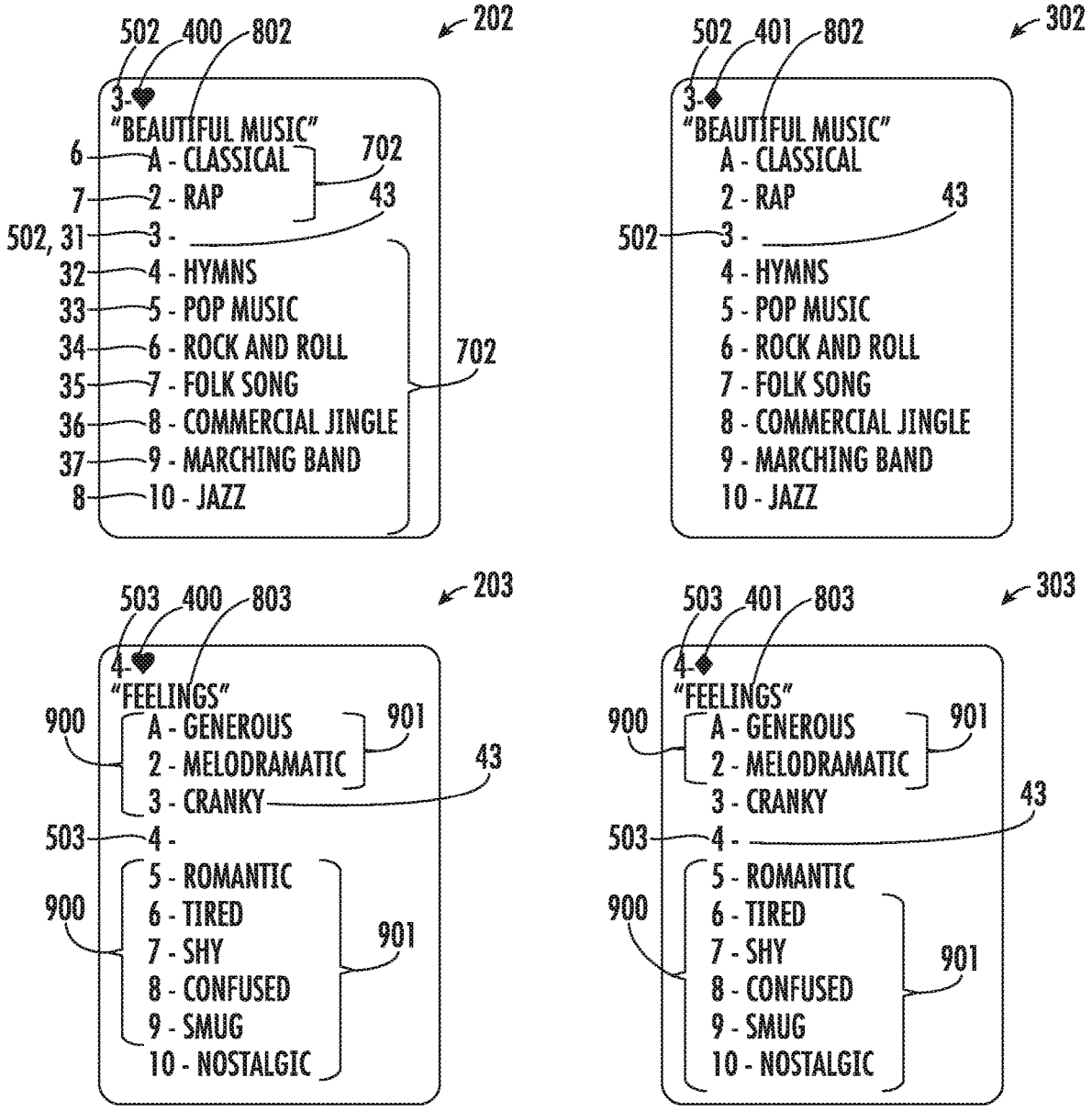
FIG. 2B shows four additional cards of the primary embodiment of the present invention, a trivia game mapped onto a standard set of playing cards: the 3♥, 3♦, 4♥, and 4♦.

FIG. 2B shows four cards 202, 203, 302, 303, the 3♥, 3♦, 4♥, 4♦ 202, 302, 203, 303, respectively. The cards 202, 302 bearing the 3 502 of ♥ 400 and 3 502 of ♦ 401 share a topic 802, answer values 6, 7, 31, 32, 33, 34, 35, 36, 37, 8, and answers 10, 51, 52, 53, 54, 55, 56, 57, 11. The card value 502 for 3 502 is shown at the top of the card as a card value 502 and as an answer value 502, 31. Likewise, the cards 203, 303 bearing the 4 503 of ♥ 400 and 4 503 of ♦ 401 share a topic 803, answer values list 900, and an answer list 901. The card value 503 for 4 503 is shown at the top of the card as a card value 503 and as an answer value 503.

Figure 2C:
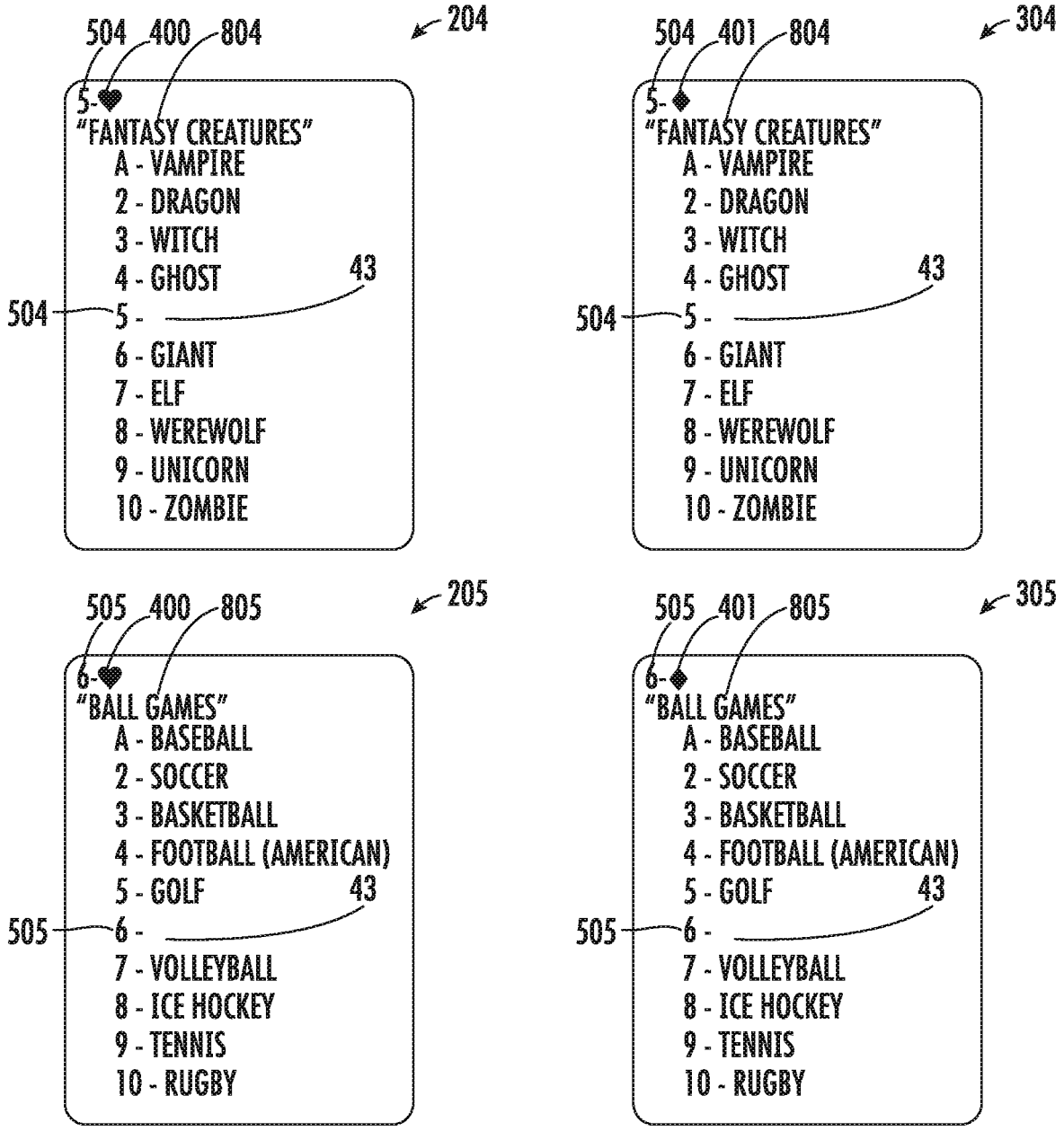
FIG. 2C shows four additional cards of the primary embodiment of the present invention, a trivia game mapped onto a standard set of playing cards: the 5♥, 5♦, 6♥, and 6♦.

FIG. 2C shows four cards 204, 205, 304, 305, the 5♥, 5♦, 6♥, 6♦ 204, 304, 205, 305, respectively. The cards 204, 304 bearing the 5 504 of ♥ 400 and 5 504 of ♦ 401 share a topic 804. The card value 504 is also an answer value 504 corresponding to an answer 43 which is a blank. Likewise, the cards 205, 305 bearing the 6 505 of ♥ 400 and 6 505 of ♦ 401 share a topic 805. The card value 505 is also an answer value 505 corresponding to an answer 43 which is a blank.

Figure 2D:
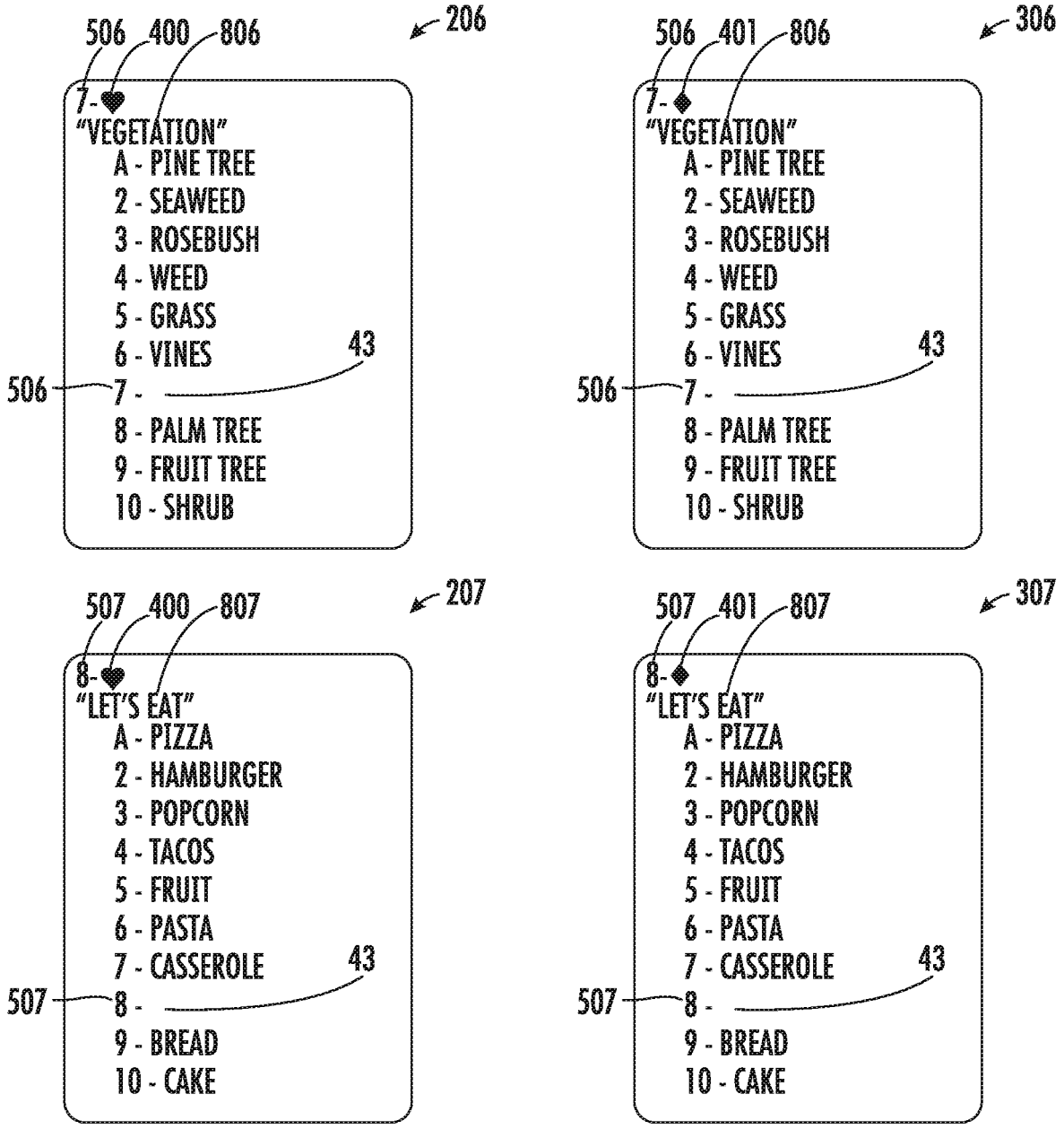
FIG. 2D shows four additional cards of the primary embodiment of the present invention, a trivia game mapped onto a standard set of playing cards: the 7♥, 7♦, 8♥, and 8♦.

FIG. 2D shows four cards 206, 207, 306, 307, the 7♥, 7♦, 8♥, 8♦ 206, 306, 207, 307, respectively. The cards 206, 306 bearing the 7 506 of ♥ 400 and 7 506 of ♦ 401 share a topic 806. The card value 506 is also an answer value 506 corresponding to an answer 43 which is a blank. Likewise, the cards 207, 307 bearing the 8 507 of ♥ 400 and 8 507 of ♦ 401 share a topic 805. The card value 507 is also an answer value 507 corresponding to an answer 43 which is a blank.

Figure 2E:
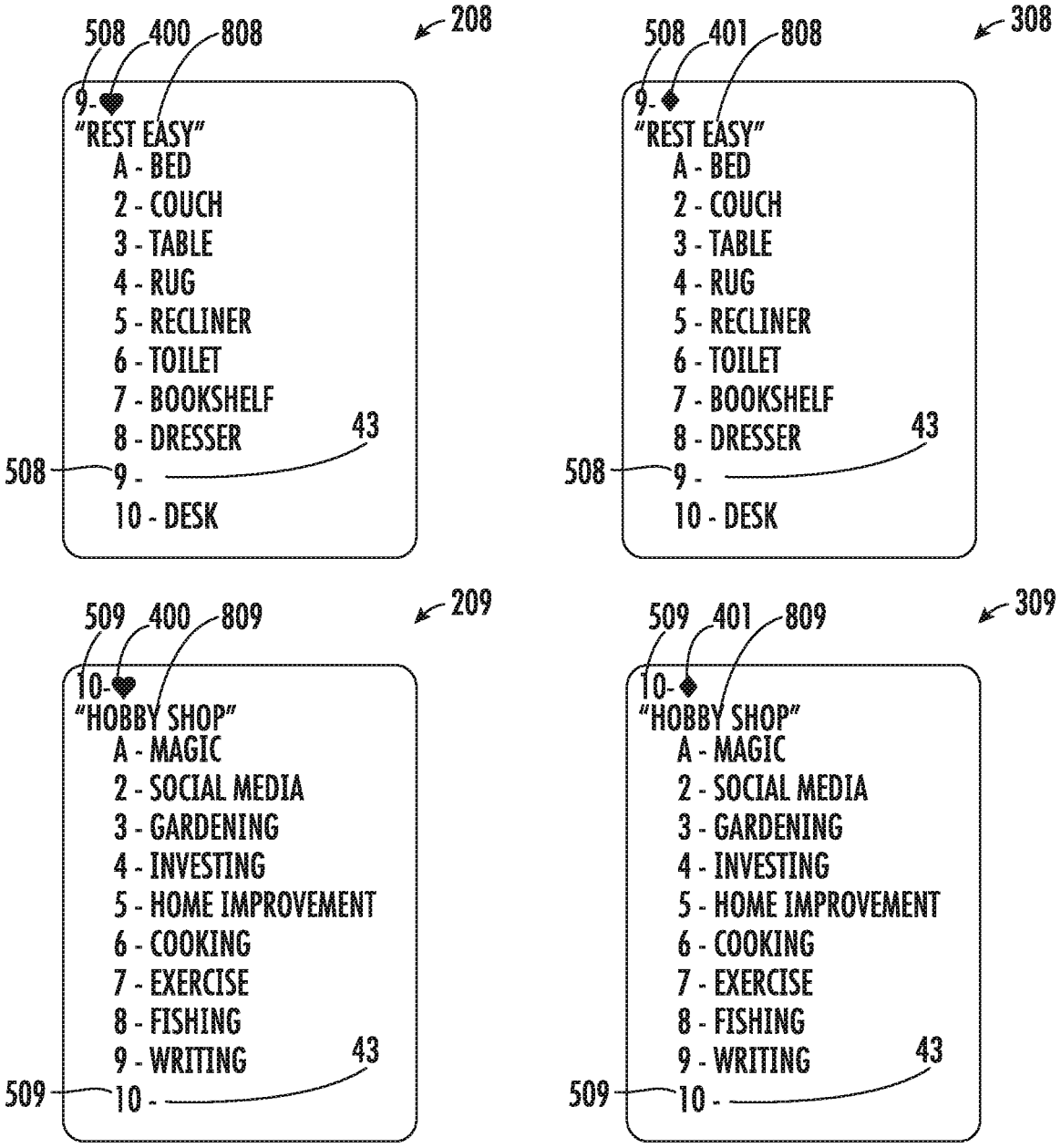
FIG. 2E shows four additional cards of the primary embodiment of the present invention, a trivia game mapped onto a standard set of playing cards: the 9♥, 9♦, 10♥, and 10♦.
Figure 3A:
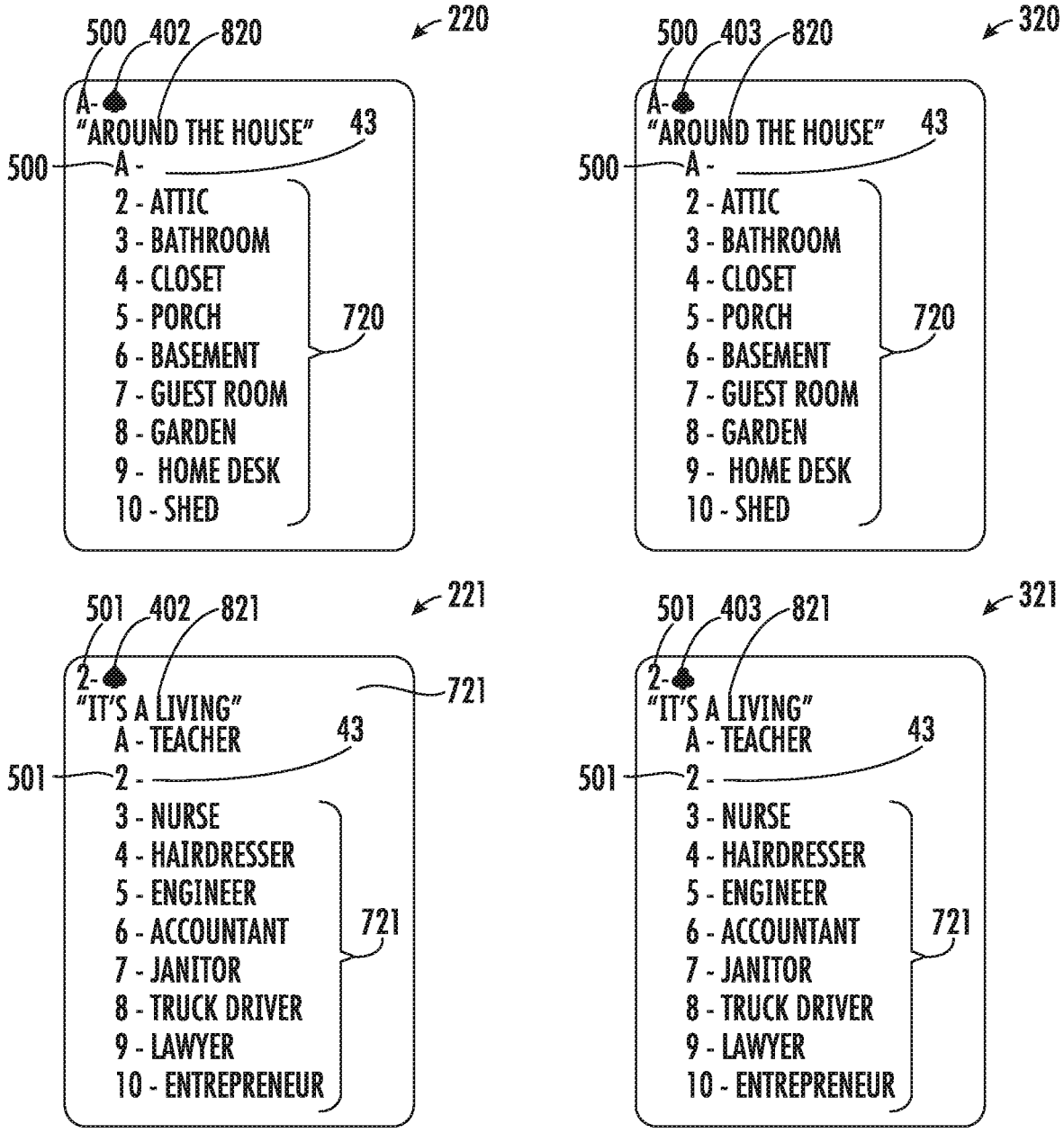
FIG. 3A shows another four cards of the primary embodiment of the present invention, a trivia game mapped onto a standard set of playing cards: A♠, A♣, 2♠, and 2♣.
Figure 3B:
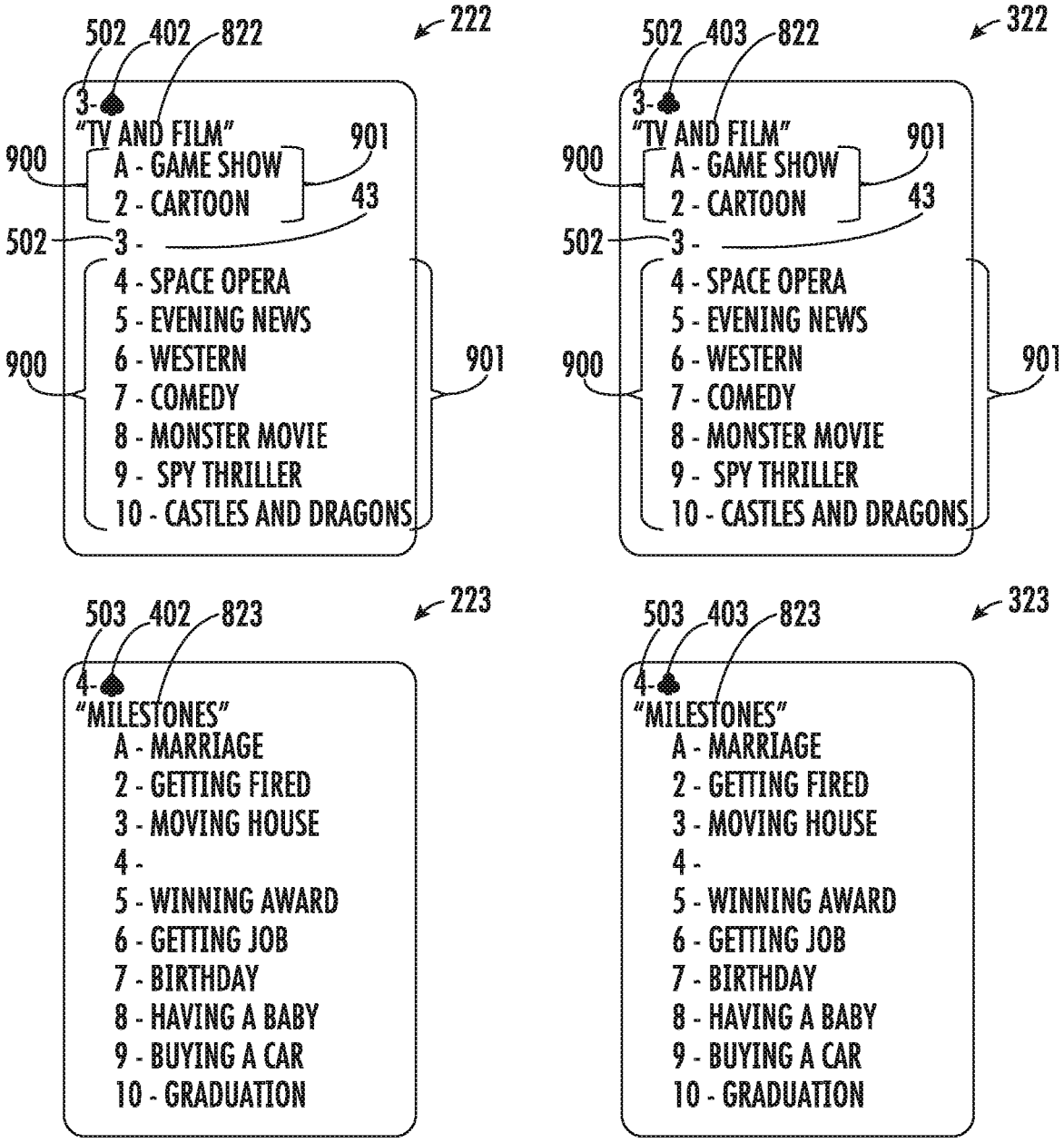
FIG. 3B shows four additional cards of the primary embodiment of the present invention, a trivia game mapped onto a standard set of playing cards: the 3♠, 3♣, 4♠, and 4♣.
Figure 3C:
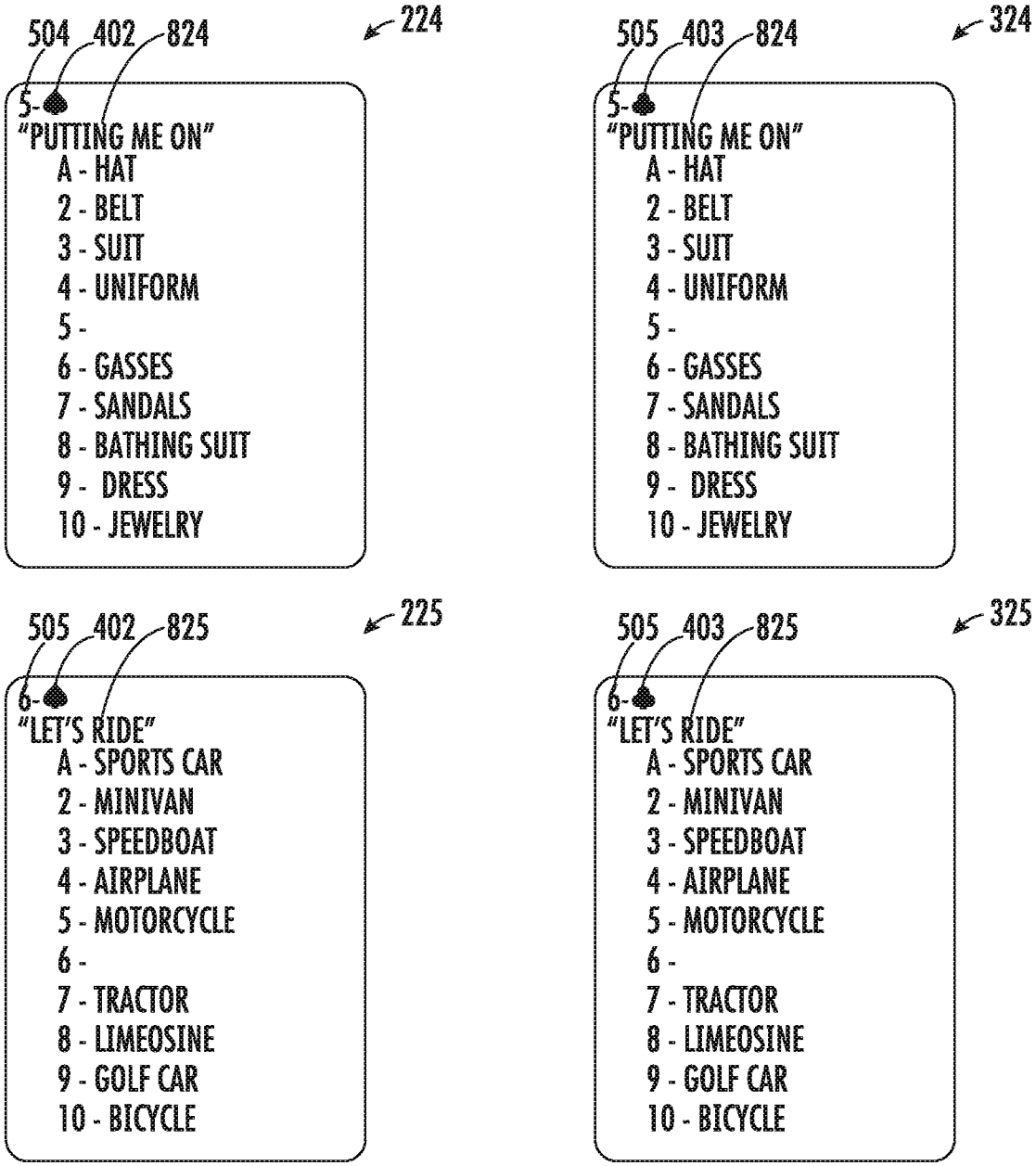
FIG. 3C shows four additional cards of the primary embodiment of the present invention, a trivia game mapped onto a standard set of playing cards: the 5♠, 5♣, 6♠, and 6♣.
Figure 3D:
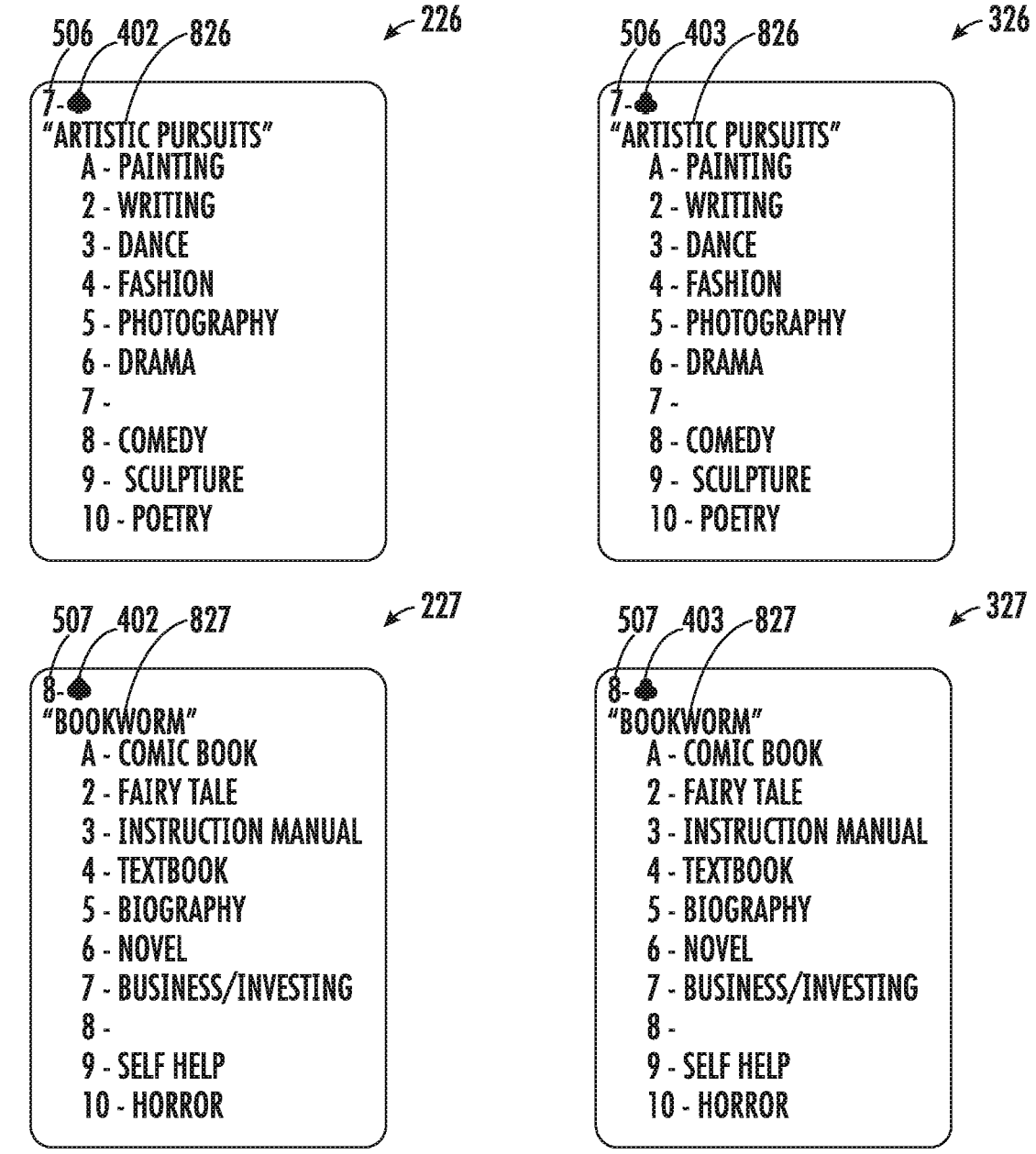
FIG. 3D shows four additional cards of the primary embodiment of the present invention, a trivia game mapped onto a standard set of playing cards: the 7♠, 7♣, 8♠, and 8♣.
Figure 3E:
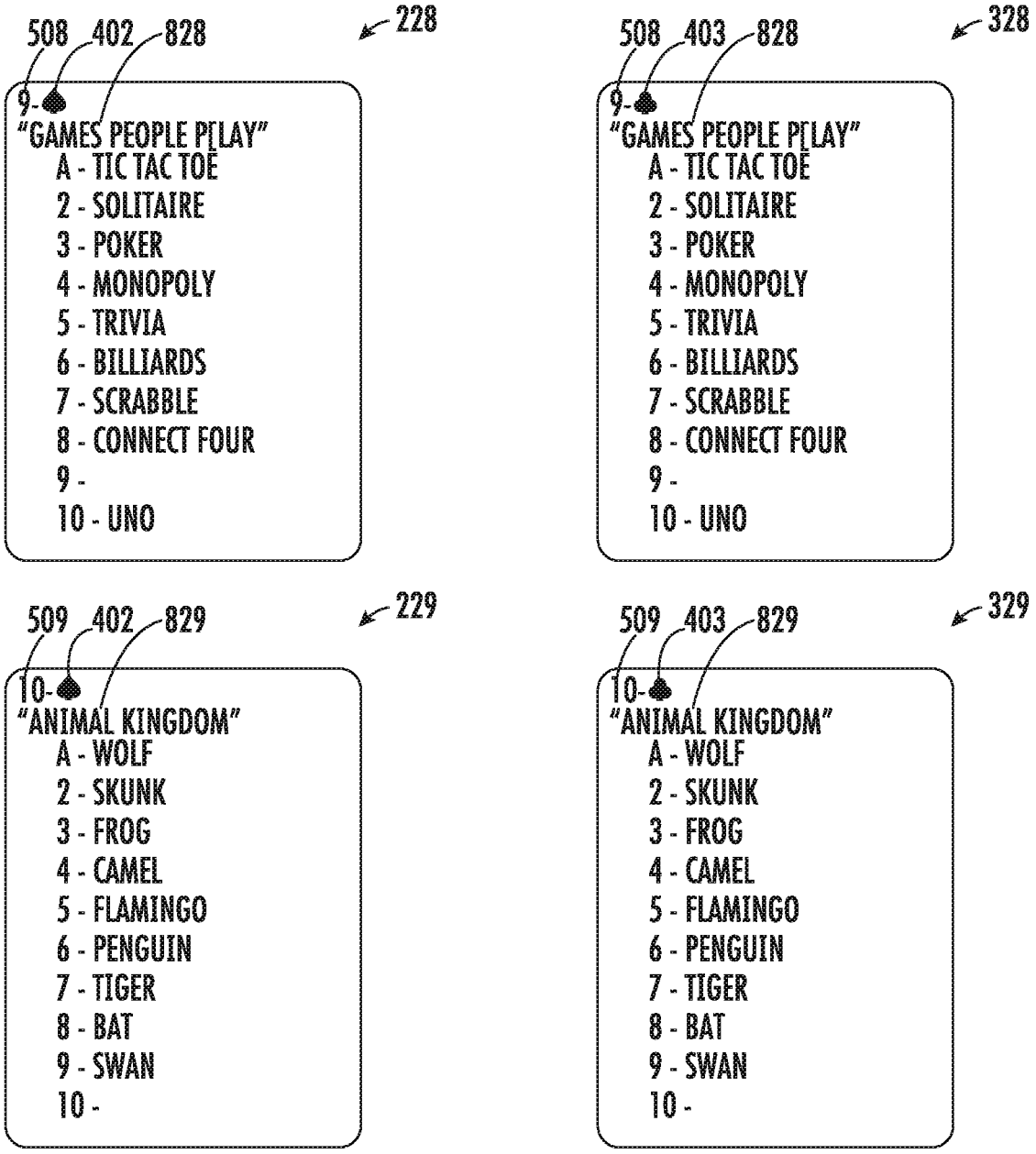
FIG. 3E shows four additional cards of the primary embodiment of the present invention, a trivia game mapped onto a standard set of playing cards: the 9♠, 9♣, 10♠, and 10♣.

FIG. 2E shows four cards 208, 308, 209, 309, the 9♥, 9♦, 10♥, 10♦ 208, 308, 209, 309, respectively. The cards 208, 308 bearing the 9 508 of ♥ 400 and 9 508 of ♦ 401 share a topic 808. The card value 508 is also an answer value 508 corresponding to an answer 43 which is a blank. Likewise, the cards 209, 309 bearing the 10 509 of ♥ 400 and 10 509 of ♦ 401 share a topic 809. The card value 509 is also an answer value 509 corresponding to an answer 43 which is a blank.

Likewise, FIGS. 3A-3E shows a plurality of cards 220, 221, 222, 223, 224, 225, 226, 227, 228, 229, 320, 321, 322, 323, 324, 325, 326, 327, 328, 329. The first plurality of cards 220, 221, 222, 223, 224, 225, 226, 227, 228, 229 are spades, ♠ 402. This is the sub-set of planar playing cards with spaces 402. The second plurality of cards 320, 321, 322, 323, 324, 325, 326, 327, 328, 329 are clubs, ♣ 403. This is the sub-set of planar playing cards with clubs 403. The spades ♠ 402 and clubs, ♣ 403 are each an index.

The A 500 of ♠ 402 card 220 and the A 500 of ♣ 403 card 320 share a topic 820, "Around the House." The topic 820 corresponds to a particular answer list 720 which is shared by both planar playing cards 220, 320. A blank 43 answer corresponds to the answer value 500 matching the card value 500. The 2 501 of ♠ 402 card 221 and the 2 500 of ♣ 403 card 321 share a topic 821, "It's a Living." The topic 821 corresponds to a particular answer list 721 which is shared by both planar playing cards 221, 321. A blank 43 answer corresponds to the answer value 501 matching the card value 501. The 3 502 of ♠ 402 card 222 and the 3 502 of ♣ 403 card 322 share a topic 822, "TV and Film." The topic 822 corresponds to a particular answer list 901, which is shared by both planar playing cards 222, 322. The answer list 901 has a corresponding answer value list 900. A blank 43 answer corresponds to the answer value 502 matching the card value 502 in the answer value list 900. It should be noted that leaving a blank 43 for the answer value 502 matching the card value 502 is done strictly to provide a visual indication for the clue-giver during game play, as to the card value 502. It is not a limitation or requirement of the actual invention.

The remainder of ♠ 402 planar playing cards 223, 224, 225, 226, 227, 228, 229 and the ♣ 403 planar playing cards 323, 324, 325, 326, 327, 328, 329 are shown in FIGS. 3B-3E in simplified fashion. The 4 503 of ♠ 402 card 223 and the 4 503 of ♣ 403 card 323 share a topic 823, "Milestones." The 5 504 of ♠ 402 card 224 and the 5 504 of ♣ 403 card 324 share a topic 824, "Putting Me On." The 6 505 of ♠ 402 card 225 and the 6 505 of ♣ 403 card 325 share a topic 825, "Let's Ride." The 7 506 of ♠ 402 card 226 and the 7 506 of ♣ 403 card 326 share a topic 826, "Vegetation." The 8 507 of ♠ 402 card 227 and the 8 527 of ♣ 403 card 307 share a topic 827, "Let's Eat." The 9 508 of ♠ 402 card 228 and the 9 508 of ♣ 403 card 328 share a topic 828, "Rest Easy." The 10 509 of ♠ 402 card 229 and the 10 509 of ♣ 403 card 329 share a topic 829, "Hobby Shop."

Figure 4A:
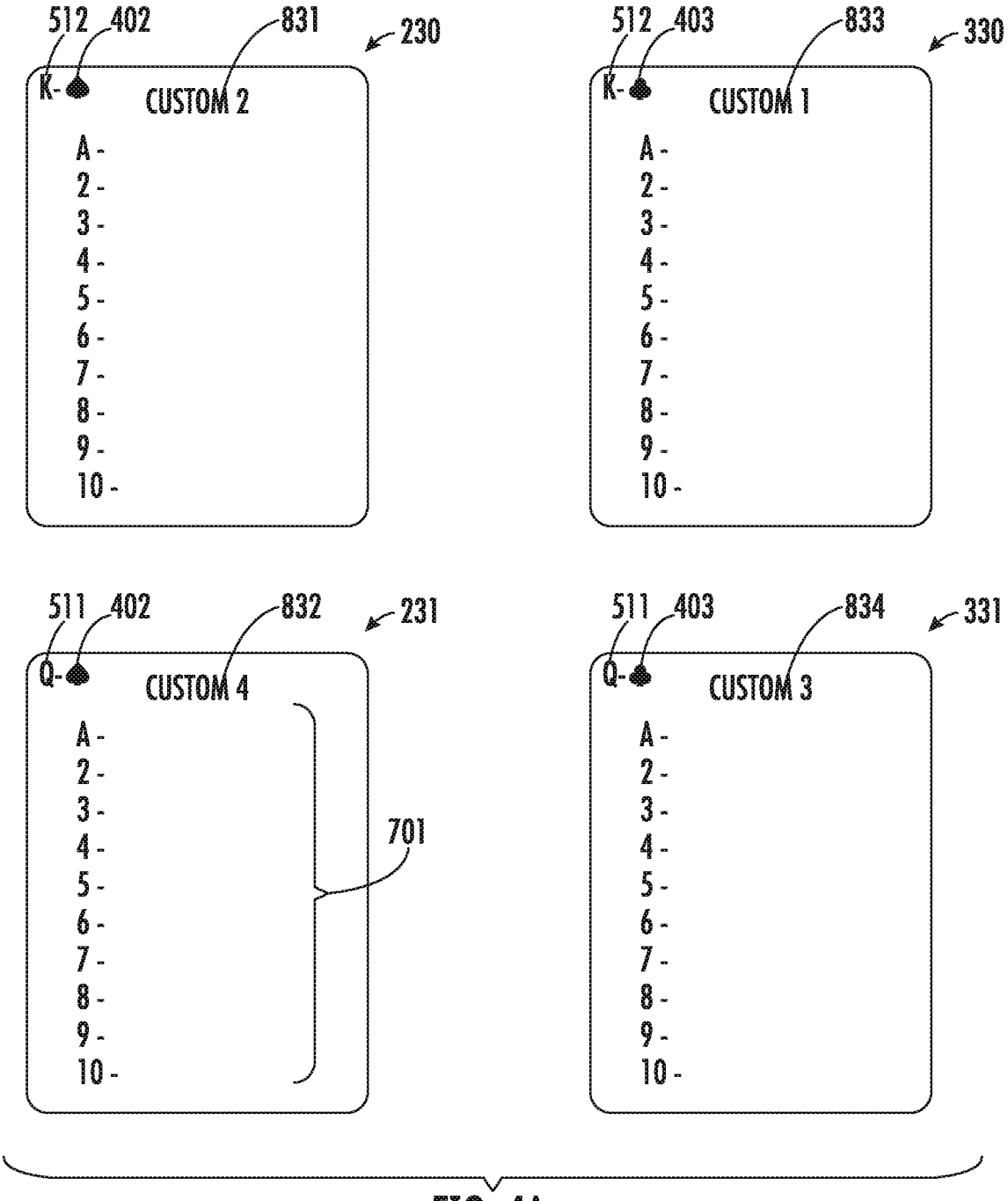
FIG. 4A shows another four cards of the primary embodiment of the present invention, a trivia game, mapped onto a standard set of playing cards: K♠, K♣, Q♠, and Q♣.
Figure 4B:
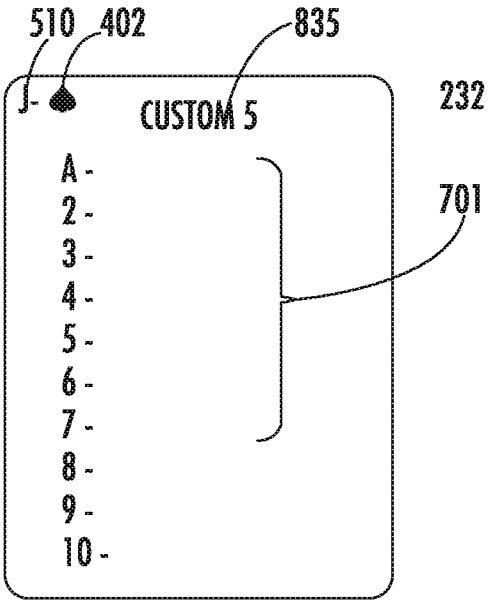
FIG. 4B shows a J♠.

FIG. 4A shows some customizable planar playing cards 230, 231, 330, 331, 232 using the face cards of ♠ (spades) 402 and ♣ (clubs) 403. The king 512 of ♠ has a custom topic 833; likewise the king 512 of ♣ 403 has a custom topic 831. Similarly, the queen 511 of ♠ 402 has a custom topic 832, and the queen 511 of ♣ 403 has a custom topic 834. FIG. 4B shows that this can be extended to jacks (J) 510: this card 232 is a J 510 of ♠ 402, with a custom topic 835 and an answer value list 701.

The concepts shown in FIGS. 2A-2E, 3A-3E, and 4A-4B allow this card game to be mapped onto a standard set of playing cards, allowing the deck to have a dual use.

The card index 4 is selected from a set of indices, which create unique sub-sets of the planar playing cards 100. For example, in FIGS. 2-4, the set of indices are ♣ 403, ♦ 401, ♥ 400, and ♠ 402. Each suit, for example ♣ 403, is a sub-set.

The card value 5 is selected from a set of card values, which create unique sub-sets of the planar playing cards 100. For example, in FIGS. 2-3, the card values are A 500, 2 501, 3 502, 4 503, 5 504, 6 505, 7 506, 8 507, 9 508, 10 509. Each card value, for example A 500, is a sub-set. The set of card values can be extended by using, as shown in FIG. 4 J 510, Q 511, and K 512. This extended set of card values A 500, 2 501, 3 502, 4 503, 5 504, 6 505, 7 506, 8 507, 9 508, 10 509, J 510, Q 511, and K 512 would correspond to that used in a standard set of playing cards.

The topic 20 creates unique sub-sets of the planar playing cards 100. For example, in FIGS. 2-3, it creates 20 unique sub-sets 800, 801, 802, 803, 804, 805, 806, 807, 808, 809, 820, 821, 822, 823, 824, 825, 826, 827, 828, 829.

The number of indices 4 multiplied by the number of card values 5, divided by the number of topics 20 identifies how many teams can play the game at one time, with each team possessing its own set of cards with identical topics. In the example given in FIGS. 2-3, there are 4 suits, 10 card values, and 20 topics. Therefore, such a deck of cards could be used by two teams. A standard set of playing cards could support other configurations. For example, with 4 suits, 12 card values, and 12 topics, four teams could play. Alternatively, the same set of topics would not be repeated on two or more indices, and all teams could simply share the same deck of cards.

To best illustrate game play, imagine a plurality of players using the cards shown in FIGS. 2A-2E. A clue-giver is selected and pulls a card at random. For this example, imagine the first card 300 is the A 500 of ♦ 401, which has a topic 800 "Road Trip." The clue-giver shows the card to all players. The clue-giver selects a second card at random. For this example, image the second card 304 is the 5 504 of ♦ 401. The clue-giver maps the card value 504 of the second card 304 onto the list of answer values 6, 7, 31, 32, 33, 34, 35, 36, 37, 8 on the first card 300 to arrive at the correct answer 53 on the first card 300. This means that the clue-giver wants the players to guess the answer 53 "Las Vegas" 53 corresponding to the answer value 33 of 5 33 on the first card 300. The clue-giver knows this because the clue-giver mapped the card value 504 of the second card 304 onto the answer values 6, 7, 31, 32, 33, 34, 35, 36, 37, 8 on the first card 300. Only the clue-giver, knows the correct answer 53 on the first card 300. The clue-giver would keep both the correct answer 53 on the first card 300 and the card value 504 of the second card 304 secret. The correct answer 53 on the first card 300 is seen by all, but the clue-giver does not disclose it. Therefore, the correct answer 53 is seen but undisclosed. The clue-giver would give clues designed to elicit the correct answer 53 from the players.

In an alternative embodiment, the players can be divided into two or more teams. In one embodiment, the opposing team would receive a sub-set of cards containing topics which are identical to those of the team of the clue-giver. For reference, in the above example, the opposing team would be looking at their card 200, the A 500 of ♥ 400. The opposing team's card 200 and the first card 300 share a topic 800 and an answer list 10, 51, 52, 53, 54, 55, 56, 57, 11. In team play, the clue-giver would design the clues so as not to inform the opposing teams about the correct answer 53. After the clue-giver was done giving clues, the opposing teams and the selected team would guess about the correct answer 53. Scoring would be based on which teams correctly picked the correct answer 53.

I claim:

1. A playing card game comprising a plurality of planar playing cards with each of the planar playing cards having a playing surface and a perimeter;

each planar playing card comprising three pieces of orthogonal information residing on the playing surface of each of the plurality of planar playing cards, an index chosen from a set of index values, a card value chosen from a set of card values, and a topic chosen from a set of topic values;

Each planar playing card further comprising an answer value list containing a plurality of unique answer values and each answer list containing a plurality of unique answers an answer value list containing a plurality of unique answer values residing on the playing surface of each of the plurality of planar playing cards with each unique answer value being chosen from a set of answer values;

an answer list containing a plurality of unique answers residing on the playing surface of each of the planar playing cards with each unique answer being chosen from a set of answers;

wherein the index identifies a plurality of unique and specific sub-sets of the plurality of playing cards, wherein the card value identifies a plurality of unique and specific sub-sets of the plurality of playing cards, wherein the topic identifies a plurality of unique and specific sub-sets of the plurality of playing cards, wherein the sub-sets created by the index are distinct from the sub-sets created by the card value and topic, and wherein at least two of the indices have identical card values, topics, answer value lists, and answer lists.

2. The playing card game of claim 1, wherein the set of card values includes the set of answer values.

3. The playing card game of claim 2, wherein, when all of the plurality of planar playing cards are sorted into sub-sets based on topic, all of the planar playing cards in each sub-set sorted by topic will have an identical list of answer values and an identical list of answers.

4. The playing card game of claim 3, wherein each of the plurality of planar playing cards has a unique combination of index, card value, and topic.

5. The playing card game of claim 4, wherein the set of index values is ♣, ♦, ♥, and ♠.

6. The playing card game of claim 5, wherein the set of card values is that used for a standard set of playing cards: Ace, 2, 3, 4, 5, 6, 7, 8, 9, 10, Jack, Queen, and King.

7. The playing card game of claim 6, wherein each of the plurality of cards has a unique combination of index and card value.

8. The playing card game of claim 7, wherein the answer value list for each of the plurality of planar playing cards contains all the values in the set of answer values.

9. The playing card game of claim 4, wherein the set of index values is the primary colors red, blue, green, orange, yellow, and purple.

10. A method of playing a card-based trivia game comprising the steps of providing a deck containing a plurality of planar playing cards, wherein each of the plurality of planar playing cards is unique; wherein each planar playing card comprising three pieces of orthogonal information residing on the playing surface of each of the plurality of planar playing cards, an index chosen from a set of index values, a card value chosen from a set of card values, and a topic chosen from a set of topic values; each planar playing card further comprising information in the form of an answer value list containing a plurality of unique answer values and each answer list containing a plurality of unique answers;

selecting a clue-giver from a plurality of players;

having the clue-giver select a first card from the plurality of planar playing cards;

showing the answer value list and answer list of unique answers on the first planar playing card to all players;

having the clue-giver select a second card from the plurality of planar playing cards provided;

having the clue-giver map a specific piece of secret information in the form of a unique answer value and a unique answer on the second planar playing card onto a specific piece of seen but undisclosed information corresponding to a unique answer value and a unique answer contained on the first planar playing card;

having the clue-giver provide clues that can be heard by all players that will allow them to ascertain the seen but undisclosed information contained on the first card;

allowing the players to guess the seen but undisclosed information contained on the first card;

scoring the game based on who correctly guessed the seen but undisclosed information contained on the first card.

11. The method of playing a card-based trivia game of claim 10, wherein each of the plurality of planar playing card has a playing surface and wherein upon the playing surface of each planar playing card is an index selected from a set of indices, a card value selected from a set of card values, a topic selected from a set of topics, an answer value list, and an answer list.

12. The method of playing a card-based trivia game of claim 11, wherein each of the plurality of planar playing cards has a unique combination of index and card value.

13. The method of playing a card-based trivia game of claim 12, wherein each answer value list contains a plurality of unique answer values and each answer list contains a plurality of unique answers.

14. The method of playing a card-based trivia game of claim 13, wherein each answer in the answer list is mapped, one-to-one, with an answer value from the list of answer values.

15. The method of playing a card-based trivia game of claim 14, wherein for each of the plurality of planar playing cards, each answer in the list of answers relates to the topic.

16. The method of playing a card-based trivia game of claim 15, wherein the specific secret information contained on the second card is the card value.

17. The method of playing a card-based trivia game of claim 16, wherein the clue-giver maps the card value of the second card onto the answer value list of the first card in order to arrive at the correct answer, which is the specific piece of seen but undisclosed information contained on the first planar playing card.

18. The method of playing a card-based trivia game of claim 17, wherein the clue-giver provides clues about the answer on the first card that corresponds to the answer value on the first card which matches the card value of the second card.

19. The method of playing a card-based trivia game of claim 18 further comprising the initial step of dividing the players into a plurality of teams.

20. The method of playing a card-based trivia game of claim 19, wherein the scoring is based on the answers given by each of the plurality of teams.

* * * * *